US011041322B2

(12) United States Patent
Blasetti

(10) Patent No.: US 11,041,322 B2
(45) Date of Patent: Jun. 22, 2021

(54) ADJUSTABLE CLADDING FOR MITIGATING WIND-INDUCED VIBRATION OF HIGH-RISE STRUCTURES

(71) Applicant: Thornton Tomasetti, Inc., New York, NY (US)

(72) Inventor: Andrew Blasetti, Ambler, PA (US)

(73) Assignee: THORNTON TOMASETTI, INC., New York, NY (US)

( * ) Notice: Subject to any disclaimer, the term of this patent is extended or adjusted under 35 U.S.C. 154(b) by 0 days.

(21) Appl. No.: 16/408,888

(22) Filed: May 10, 2019

(65) Prior Publication Data

US 2019/0345729 A1 Nov. 14, 2019

Related U.S. Application Data

(60) Provisional application No. 62/669,528, filed on May 10, 2018.

(51) Int. Cl.
*E04H 9/02* (2006.01)
*E04H 9/14* (2006.01)

(52) U.S. Cl.
CPC ..... *E04H 9/0215* (2020.05); *E04H 9/14* (2013.01)

(58) Field of Classification Search
CPC ..... E04H 9/14; E04H 9/0215; E04F 13/081; E04F 13/145; E04F 13/12; E04F 13/0733; E04F 2290/04; E05F 15/72
See application file for complete search history.

(56) References Cited

U.S. PATENT DOCUMENTS

| | | | | |
|---|---|---|---|---|
| 7,096,629 | B1 | 8/2006 | Cox | |
| 10,560,050 | B2 * | 2/2020 | Raghunathan | H02S 40/10 |
| 2008/0309122 | A1 | 12/2008 | Smith et al. | |
| 2010/0252208 | A1 * | 10/2010 | Svirsky | E04F 10/10 160/61 |
| 2012/0137610 | A1 | 6/2012 | Knight et al. | |
| 2012/0299330 | A1 | 11/2012 | Breidenbach | |
| 2013/0283656 | A1 * | 10/2013 | Melic | G09F 15/0087 40/602 |
| 2014/0165485 | A1 * | 6/2014 | Gaudreau | E04F 13/0733 52/287.1 |
| 2014/0251929 | A1 * | 9/2014 | Fidler | G09F 15/0037 211/1.3 |
| 2018/0001218 | A1 | 1/2018 | Sinn et al. | |
| 2018/0102734 | A1 * | 4/2018 | Katz | H02S 20/30 |

OTHER PUBLICATIONS

International Search Report issued for PCT/US2019/031798, dated Aug. 27, 2019.
Written Opinion of the International Searching Authority issued for PCT/US2019/031798, dated Aug. 27, 2019.
Lignarolo, Lorenzo et al.; "Shape morphing wind-responsive facade systems realized with smart materials"; Adaptive Architecture: An International Conference, London, UK, Mar. 3-5, 2011. Available at<https://repository.tudelft.nl/islandora/object/uuid%3Abe165d55-9acb-4f1 a-9cc1-5685d33676f1/datastream/OBJ/download>.

* cited by examiner

*Primary Examiner* — Jessie T Fonseca
(74) *Attorney, Agent, or Firm* — Arent Fox LLP

(57) ABSTRACT

A system, device and method for reducing wind-induced vibration using cladding includes one or more movable panels attached to an outer facade of a high-rise building, skyscraper or any other structure subject to wind-induced vibration.

13 Claims, 18 Drawing Sheets

A. MECHANIZATION ASSEMBLY FRONT VIEW
1:20 *PROTECTIVE SHROUD NOT SHOWN

SECTION C-C
1:10

SECTION D-D
1:10

ADJUSTABLE CLADDING FOR MITIGATING WIND-INDUCED VIBRATION OF HIGH-RISE STRUCTURES

CROSS-REFERENCE TO RELATED APPLICATION

The application claims priority to U.S. Provisional Patent Application No. 62/669,528, filed on May 10, 2018, the contents of which are hereby incorporated in their entirety.

TECHNICAL FIELD

The present disclosure is directed to systems, devices and methods for reducing vibration, and in some aspects provides systems for reducing wind-induced vibration using cladding comprising one or more movable panels attached to an outer facade of a high-rise building, skyscraper or any other structure subject to wind-induced vibration.

BACKGROUND

Tall buildings often require supplemental damping to keep the wind-induced vibrations at a level imperceptible by most building occupants during wind storms. Damping devices have been developed which are able to mitigate structural vibration to varying extents. However, each of the general implementations currently known in the art is subject to limitations inherent to the structure and physical principles underlying these devices. For example, devices based upon a solid mass counterweight, such as tuned mass dampers ("TMDs") and active mass dampers ("AMDs"), are expensive and heavy (e.g., weighing hundreds of tons). These implementations operate, for example, by swinging or sliding a solid weight counter based on the sway of the building. However, a solid weight counter reduces the amount of leasable floor space in a building and typically requires extensive customization thereby increasing costs. Alternative liquid-based damper systems are known in the art, such as traditional tuned liquid dampers ("TLDs"), which function as a "slosh tank" as the building sways thereby absorbing vibration energy. As with the solid mass dampers, traditional TLDs suffer from increased costs resulting from the custom-built nature of these devices and maintenance costs associated with maintaining a large tank of liquid and again the concomitant loss in leasable floor space.

The tuned liquid column damper ("TLCD") is an alternative liquid-based damper solution, which partially mitigates the drawbacks of traditional TLDs. A standard TLCD is a U-shaped tank filled with water and sized such that the water naturally oscillates in the tank at the same frequency as the wind-induced building motion. A limitation of the TLCD is that it is tuned to a particular frequency by design and cannot be tuned to a different frequency without a major retrofit of the finished damper. Furthermore, TLCDs typically require a large amount of horizontal space and so they cannot fit in buildings with small or narrow footprints, such as slim skyscrapers, which are becoming increasingly popular among urban developers. In addition, the motion of the water in the TLCD does not dissipate energy consistently when the amplitude of motion varies. Finally, the TLCD tank is typically made of concrete and may leak over time thereby increasing costs.

The shortcoming of standard TLCDs may be partially addressed by an alternative implementation, consisting of a U-shaped pipe filled with water similar to a standard TLCD, but capped at one end with a gas spring (the "spring TLCD"). The gas spring allows the spring TLCD to be tuned to a broader range of frequencies than standard TLCDs. However, the spring TLCD remains subject to a substantial limitation in that the adjustable stiffness of the gas spring can only add to the gravity-induced stiffness of the U-shaped pipe. The total stiffness of the spring TLCD can therefore never be less than this gravity-induced stiffness, which is too high to time the damper to the low frequencies of very tall buildings. As a result, the spring TLCD cannot be relied upon to efficiently dampen wind-induced vibrations in tall buildings (e.g., slender skyscrapers) above a height-to-width ratio of 10. Furthermore, the vertical ends required by a TLCD are obtrusive and reduce the number of viable placement locations within a structure.

Given these shortcomings associated with standard and spring TLCDs as well as other damper devices known in the art (e,g., solid mass, piston and bellows-based devices), there exists a need for alternative vibration mitigation systems, devices and methods which are capable of minimizing wind-induced motions without requiring as much space as traditional dampers as well as solutions which are capable of compensating for vibration across a wide frequency range.

BRIEF SUMMARY OF THE INVENTION

The present disclosure provides various configurations of a system for reducing or minimizing wind-induced vibration, comprising a cladding comprising a plurality of movable panels, means for attaching the cladding to a structure, means for moving the movable panels and a processor configured to control the movement of the movable panels using the means for moving the panels.

In a first exemplary aspect, the structure is a building and the cladding is attached to at least a portion of an outer facade of the building. In some aspects, at least a portion of the cladding forms a corner of the building. In some aspects, one or more of the movable panels forming, the cladding comprise a transparent or translucent portion. The cladding may be attached to the building using a plurality of sliding tracks configured to allow and/or control movement of at least some of the plurality of movable panels. The means for moving the movable panels may comprise of electric or hydraulic systems and/or at least one motor/actuator.

In some aspects, the processor is configured to control the movement of the movable panels by adjusting an amplitude and/or frequency of one or more of the movable panels. For example, the processor may be configured to control the movement of the movable panels in response to wind speed and/or direction parameters. Wind speed and/or direction parameters may be detected and/or measured by a sensor attached or in proximity to the building.

In some aspects, the processor is further configured to receive parameters describing wind speed and direction and control the movement of the movable panels based upon the received parameters. In some aspects, the system further includes a sensor configured to detect wind speed and direction parameters, wherein the processor is further configured to control the movement of the movable panels based upon the detected wind speed and direction parameters. In some aspects, the structure is a building and the processor is further configured to move the movable panels at a frequency and/or amplitude that reduces wind-induced vibration of the building.

In still further aspects, a method for reducing wind-induced vibration of a structure is provided, comprising the steps of receiving from a sensor parameters describing wind speed and direction, controlling by a processor means for moving a plurality of movable panels forming a cladding attached to an outer facade of the structure, moving at least some of the movable panels forming the cladding, using the means for moving one or more movable panels based upon the received parameters describing wind speed and direction. In some aspects, at least some of the movable panels forming the cladding are moved at a frequency and/or amplitude that reduces wind-induced vibration of the structure.

This simplified summary of exemplary aspects of the disclosure serves to provide a basic understanding of the invention. This summary is not an extensive overview of all contemplated aspects, and is intended to neither identify key or critical elements of all aspects nor delineate the scope of any or all aspects of the invention. Its sole purpose is to present one or more aspects in a simplified form as a prelude to the more detailed description of the invention that follows. To the accomplishment of the foregoing, the one or more aspects of the invention include the features described and particularly pointed out in the claims.

DETAILED DESCRIPTION OF THE INVENTION

Exemplary aspects of the disclosure are described herein in the context of an adjustable cladding system and related methods, various aspects of which being suitable to reduce vibrations when incorporated into tall buildings or structures such as skyscrapers and towers. Persons of ordinary skill in the art will realize that the following description is illustrative only and is not intended to be in any way limiting. Other aspects will readily suggest themselves to those skilled in the art having the benefit of this disclosure. Reference will now be made in detail to implementations of the example aspects as illustrated in the accompanying drawings. The same reference indicators will be used to the extent possible throughout the drawings and the following description to refer to the same or like items.

As indicated above, many modern structures (e.g., tall and super tall building) are adversely affected by vortex-induced vibration. Traditionally, wind-induced motion control has been addressed via supplemental damping. However, the present disclosure presents an alternative to supplemental damping in the form of a cladding system that can be actively controlled (e.g., to modify the shape of the outer facade of the structure). For example, windward corners of the outer facade of a structure may be displaced laterally in a harmonic motion with a predetermined frequency and amplitude. The frequency of motion may be selected to match the structure's natural frequency of vortex shedding. The amplitude of motion may vary: larger motions will yield better control over vortex formation and a reduction of overturning moment the across-wind direction. Amplitude may thus be adjusted to produce the desired level of moment reduction. Moreover, corner panels may be displaced in opposing directions based on story height, causing wind vortices (and resulting negative pressures) to form on both side walls of the structure simultaneously, as opposed to one side wall at a time which is normally the case. In short, cladding systems according to the present disclosure may be used to control where the across-wind forces act upon a structure, so as to minimize overturning at the base and the resulting across-wind accelerations. Such systems may be advantageously installed on tall car super tall buildings, or on any other structures subject to wind-induced vibration (e.g., chimneys, masts and/or antennae). These principles will become further apparent in light of the following description of the figures and examples provided herein.

Figure 1A:
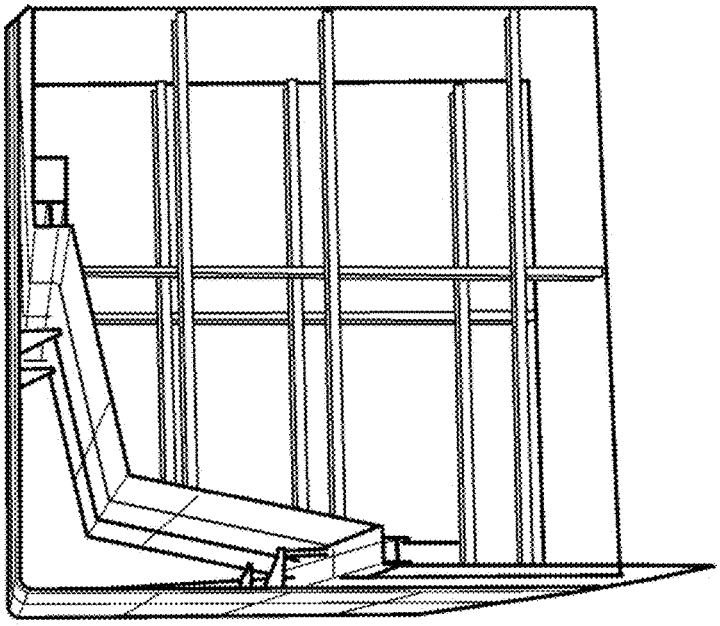
FIG. 1A is a horizontal cross-sectional view of a building having an adjustable cladding attached to an outer facade of the building. This view is offset by approximately 5° to show additional detail.
Figure 1B:
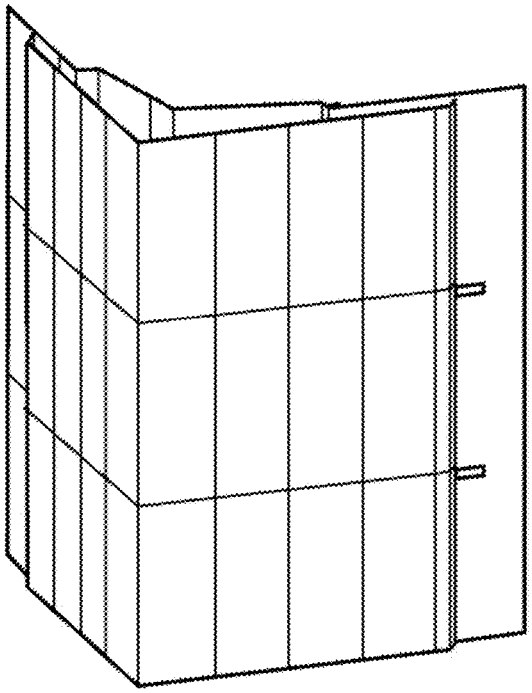
FIG. 1B is a perspective view of a portion of the cladding shown in FIG. 1A.
Figure 1C:
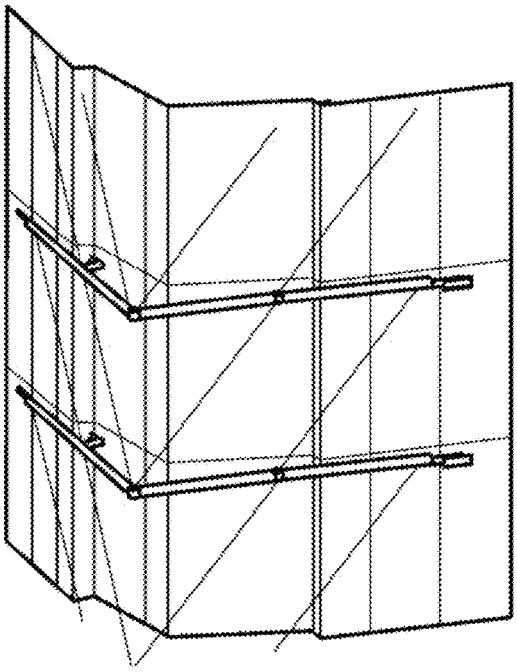
FIG. 1C is a perspective view of the underlying support structure and sliding tracks used to anchor the cladding shown in FIG. 1B to the building.
Figure 1D:
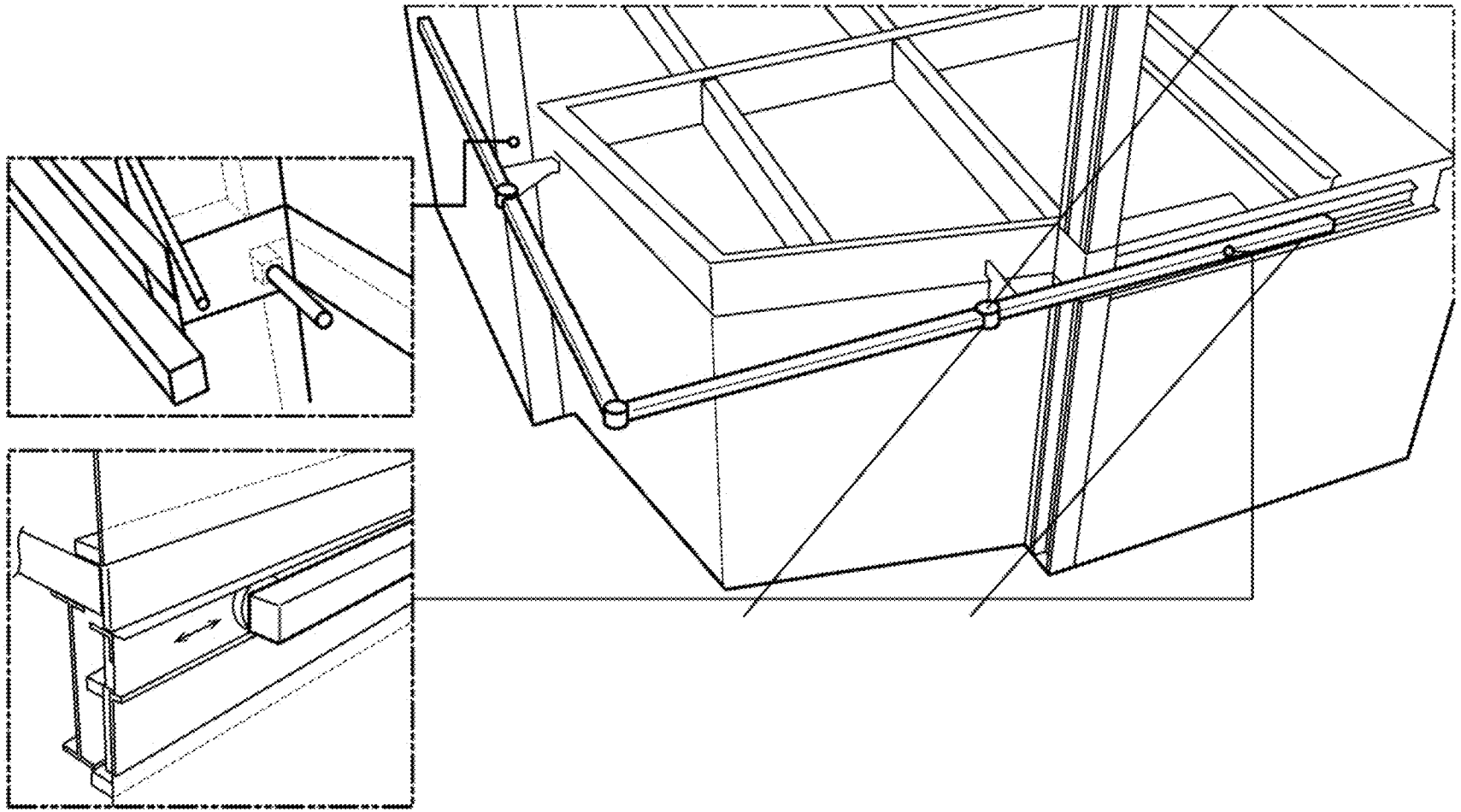
FIG. 1D is a perspective view of the support structure used to anchor the cladding to the building as shown in FIG. 1C, with additional details depicted.

FIG. 1A is a horizontal cross-sectional view of a building having an adjustable cladding attached to an outer facade of the building which comprises a plurality of movable plates with the cladding arranged in a configuration wherein the plates form a perpendicular corner of the outer facade. FIG. 1B is a perspective view of a portion of the cladding shown in FIG. 1A. FIG. 1C is a perspective view of the underlying support structure and sliding tracks used to anchor the cladding shown in FIG. 1B to the building. FIG. 1D is a perspective view of the support structure used to anchor the cladding to the building as shown in FIG. 1C, with additional details depicted.

In the exemplary aspect shown by FIGS. 1A to 1D, the movable panels forming the cladding are structured to provide a corner element of the outer facade of a building. Multiple sliding tracks and attachment points anchor the cladding to the underlying facade. Diagonal struts, in this instance, provide further structural support. The movable panels of this cladding may be repositioned, vibrated and/or flexed using a hydraulic system controlled by a local or remote computer or other electronic device. In some aspects, the computer may be a central computer located within the building which is wirelessly connected to multiple cladding components installed on the corners of the outer facade of the building. The computer or other electronic device controlling the movement of the movable panels may do so in response to wind direction and speed parameters provided by a local or remote sensor. In some aspects, the sensor may be a local sensor installed on the building which monitors wind speed and direction providing real-time or periodic updates to the computer or electronic device.

In some aspects, the movement of the movable panels will be configured to mitigate, reduce or eliminate wind-induced vibration (e.g., sway) of the building. For example, the motion caused by the movement of the movable panels may be used to redirect alternating wind flow around the building at controlled frequencies that differ from the natural vortex-shedding frequencies. The computer or other electronic device controlling the panels may use wind speed and direction parameters or other information provided by at least one sensor to determine the amplitude and frequency of panel movement of cladding so as to minimize the overturning moment and resulting sway imposed onto the structure. In some aspects, the panel movement may be controlled on a floor-by-floor basis, e.g., with the movement of multiple cladding installations being controlled independently at different levels of the building.

Moveable panels of the adjustable cladding described herein may supplement the primary facade of a building (e.g., they may be attached to the outside of this weather barrier). It is appreciated that movable panels may be constructed from any facade construction material known in the art (glass, metal, ETFE, etc.) and that the choice of material may be selected for any given implementation based upon functional and/or aesthetic concerns without departing from the spirit of the invention.

As indicated above, movable panels of the cladding described herein may be anchored to a primary facade of a building or other structure (e.g., by sliding tracks) and controlled using a hydraulic or electric system. In some aspects, movable panels may include one or more hinges or other elements allowing the panels to rotate, deform and/or flex along one or more axes. The amplitude and frequency of such movement may be configured based upon data provided by one or more sensors communicatively linked to the computer or other electronic device. It is further appreciated that specific panel dimensions, motions and frequencies may be custom-designed for each unique structure based upon the structure's geometry, stiffness, surroundings and/or local wind climate.

Figure 2:
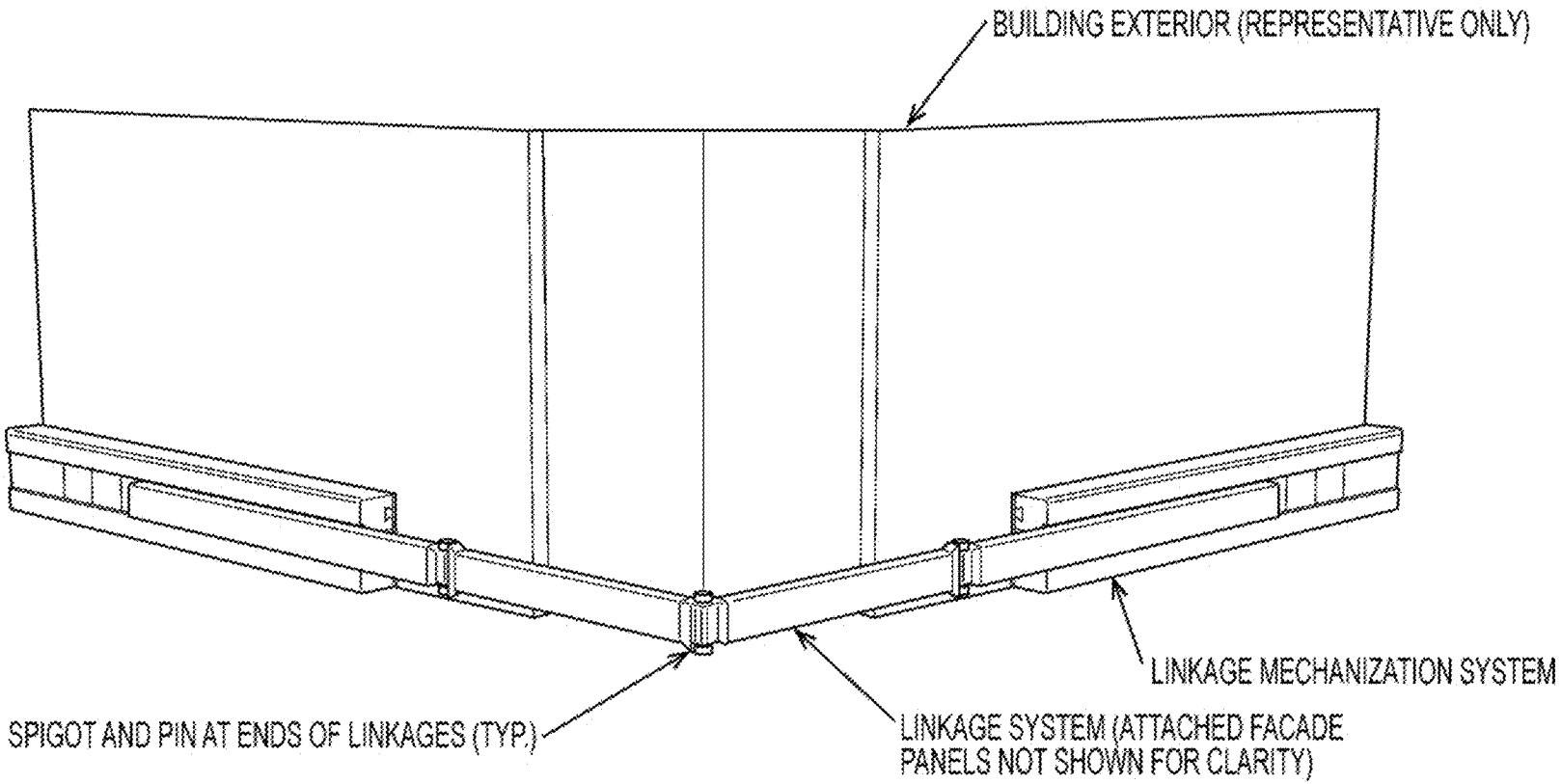
FIG. 2 is a perspective view of a cladding system according to an exemplary aspect of the disclosure, attached to a representative building exterior.

FIG. 2 is a perspective view of a cladding system according to an exemplary aspect of the disclosure, attached to a representative building exterior. As illustrated by this Figure, a cladding system according to the disclosure may comprise one or more linkage mechanization systems attached to the exterior of a structure (e.g., an inner cladding of a building). These linkage mechanization systems may be operably connected to one or more linkage systems, which are in turn connected by reconfigurable joints (e.g., a spigot and pin as shown in this example). The linkage system may comprise one or more reconfigurable support structures. In some aspects the linkage system may comprise a plurality of segments connected by reconfigurable joints. Movable outer cladding (e.g., facade panels) may be attached to at least a portion of the linkage system. The linkage system may thus be adjusted via the mechanization system(s) to reposition the movable outer cladding (e.g., to reduce wind shear).

Figure 3:
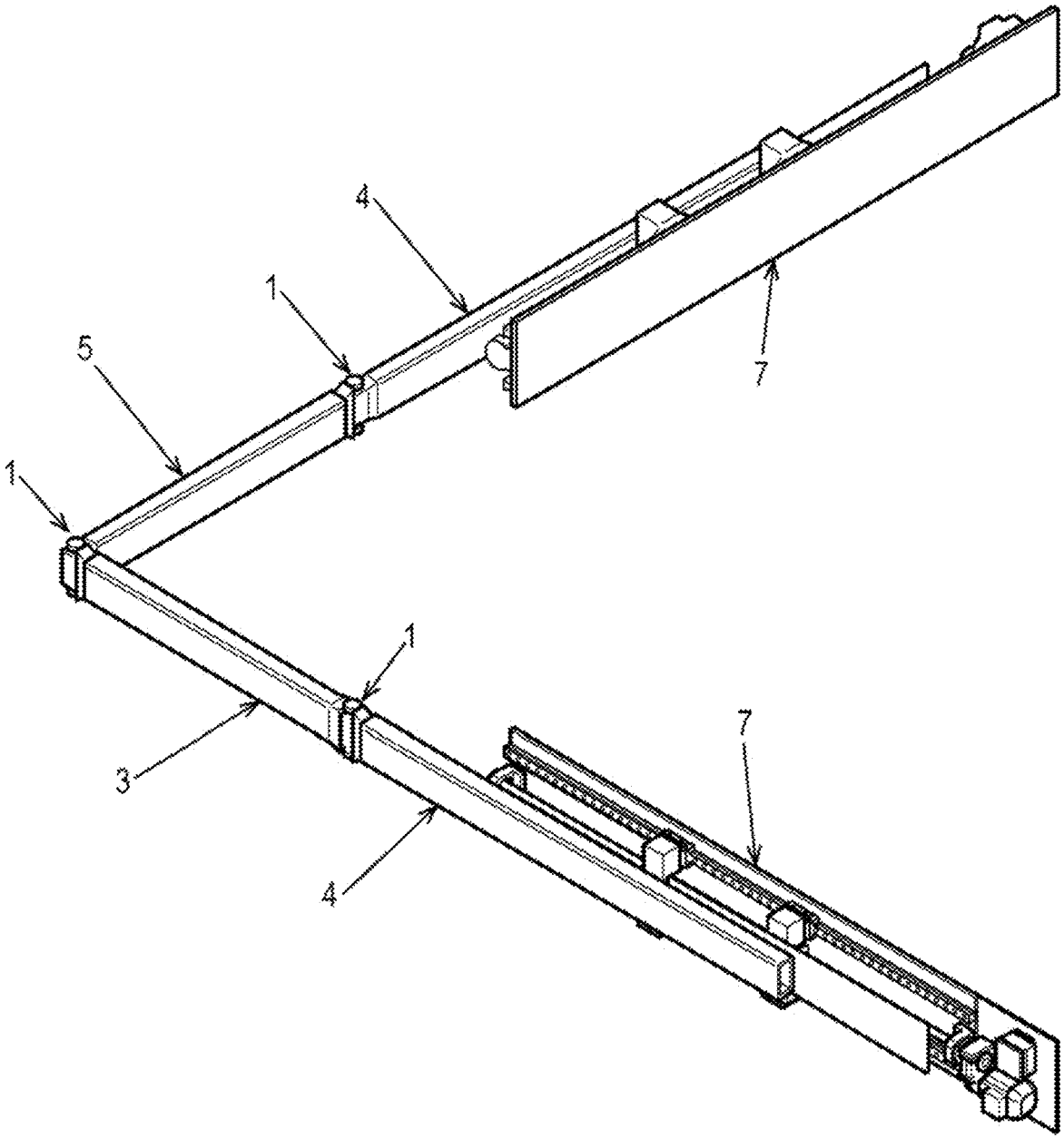
FIG. 3 is a perspective view of the cladding system shown in FIG. 2, detached from the representative building exterior.

FIG. 3 is a perspective view of the cladding system shown in FIG. 2, detached from the representative building exterior. As illustrated by this Figure, a cladding system according to the disclosure may comprise one or more pin elements (1) used to connect multiple linkage assemblies (e.g., linkage assembly A (3), linkage assembly B (4) and linkage assembly C (5) in this example) which together form a linkage system. In this case, the linkage system terminates at both ends in a linkage assembly B (4) element, each of which being in turn operably connected to a mechanization assembly (7). In other exemplary aspects, the linkage system may comprise any number of linkage assemblies. Each linkage assembly may be connected to one or more adjacent or proximal linkage assemblies, horizontally, vertically, or along any other arbitrary axis as desired for a given building exterior.

Figure 4A:
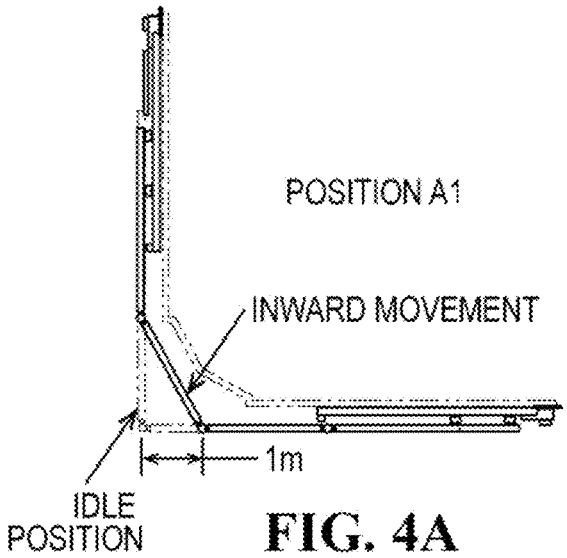
FIGS. 4A-4D depict top view perspectives of the cladding system shown in FIG. 2, configured in four respective arrangements.
Figure 4B:
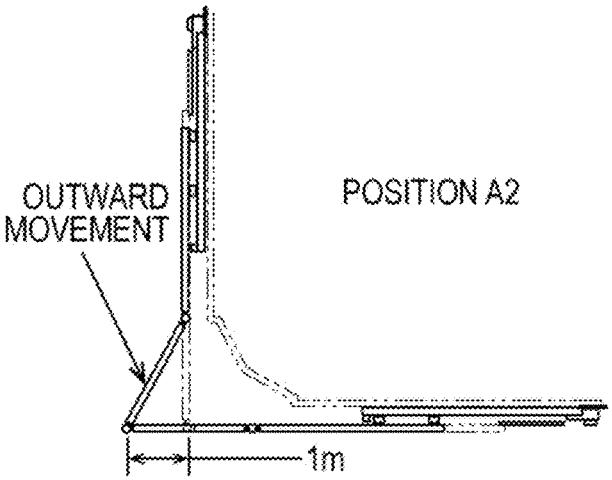
Figure 4C:
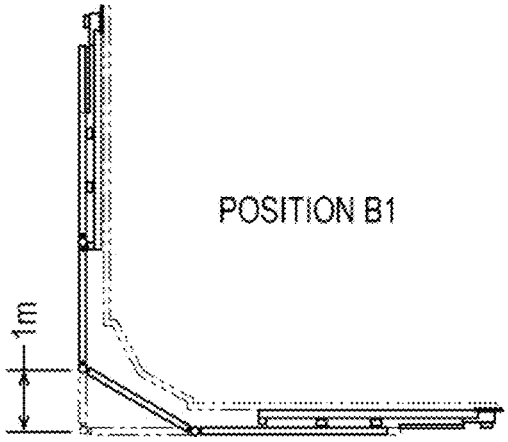
Figure 4D:
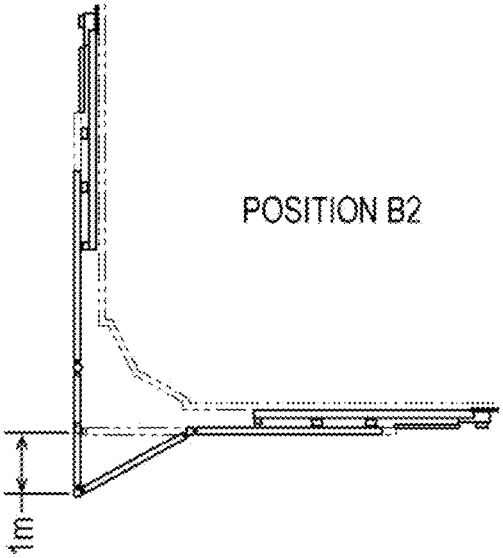

FIGS. 4A-4D depict top view perspectives of the cladding system shown in FIG. 2, configured in four respective arrangements. As illustrated by this series of Figures, the mechanization assemblies of cladding systems described herein may be used to control the linkage system (e.g., by repositioning one or more linkage assemblies). The repositioning of a linkage system may include an adjustment of the angle and/or distance between two adjacent linkage assemblies. For example, FIG. 4A depicts "Position A1" wherein a labeled linkage assembly is shown in an idle position (inward movement, in this example). FIG. 4B depicts an alternative "Position A2" wherein this linkage assembly has shifted into a new outward position. In this case, the movement was actuated by a single mechanization assembly (lower-right). However, in other aspects, the repositioning process may involve the coordinated activity of multiple mechanization assemblies acting simultaneously or in sequence. FIGS. 4C and 4D depict a similar repositioning event, in this case illustrating a repositioning caused by the second mechanization assembly (upper-left). To be clear, FIGS. 4A-D illustrate examples wherein the corner of a structure's facade is reshaped (e.g., "corner softening"

intended to reduce wind shear). However, in other aspects linkage assemblies along the internal edges of a structure may alternatively be repositioned.

Figure 5:
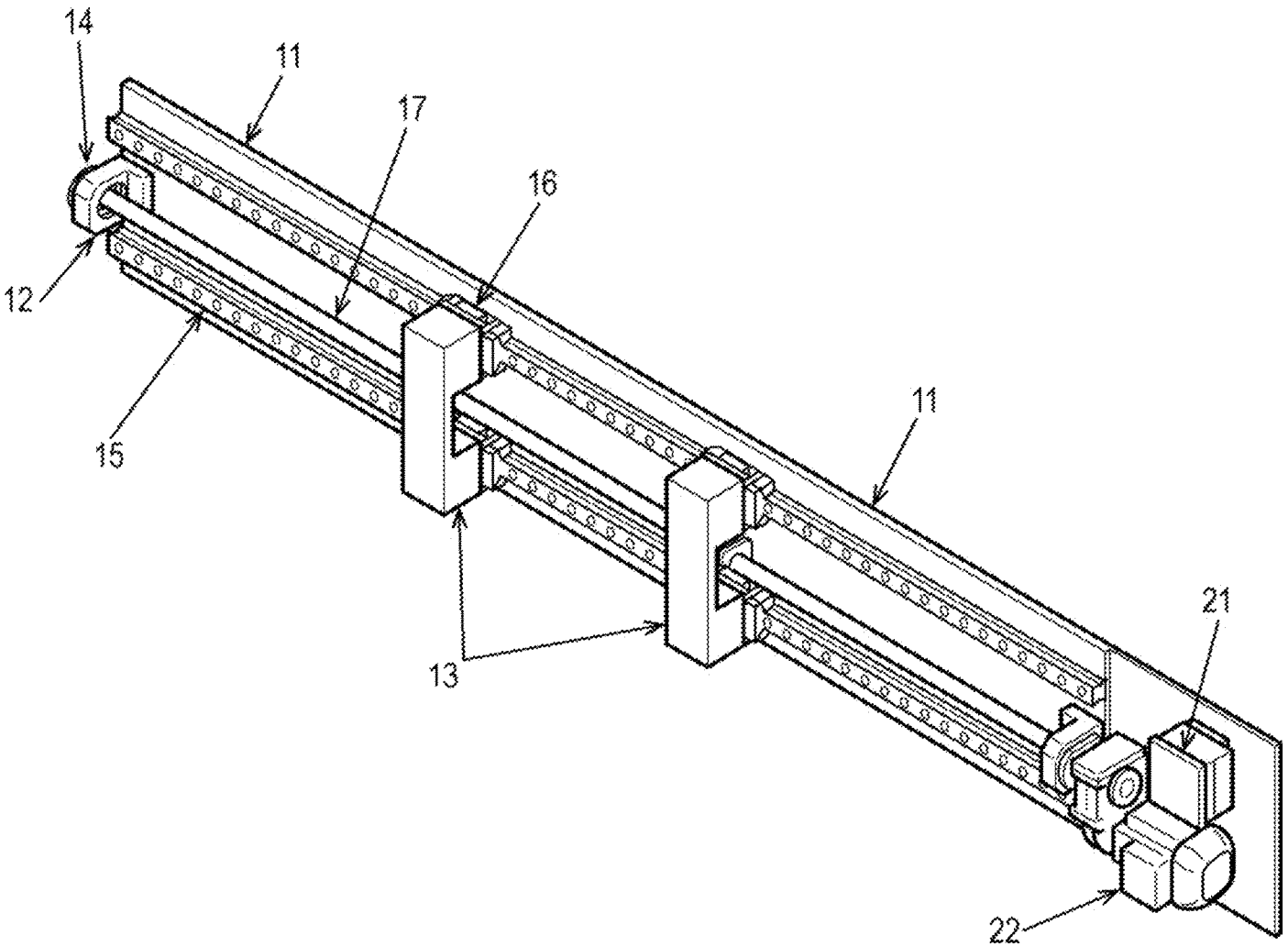
FIG. 5 is a rear perspective view of the mechanization assembly of the cladding system shown in FIG. 3.

FIG. 5 is a rear perspective view of the mechanization assembly of the cladding system shown in FIG. 3. This view highlights the structure of an exemplary mechanization assembly according to the disclosure. In this case, the mechanization assembly is configured to provide a powered linear slide mechanism (e.g., to control and actuate the linear motion of one or more linkage assemblies operably connected to the mechanization assembly). As illustrated by this Figure, a mechanization assembly may comprise a rail base (11); one or more screw end mounts (12); guide mounts (13); screw end bearings (14); guide rails (15); and guide carriages (16). It may further include one or more ball screws (17); ball screw nuts; ball nut housings; guide rail shrouds; as well as an electrical enclosure (21) and gear motor (22). In some aspects, only a portion of the above-identified components are utilized. It will be apparent that any suitable mechanical system known in the art may be employed to control the linear motion of the linkage assemblies of a cladding system according to the disclosure.

Figure 6A:
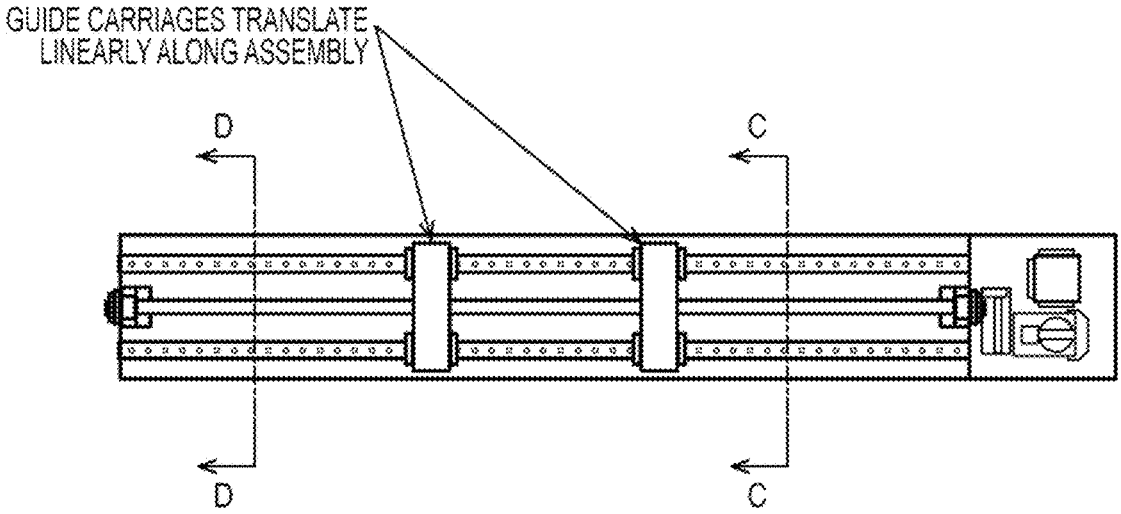
FIG. 6A is a rear view of the mechanization assembly shown in FIG. 5.
Figure 6B:
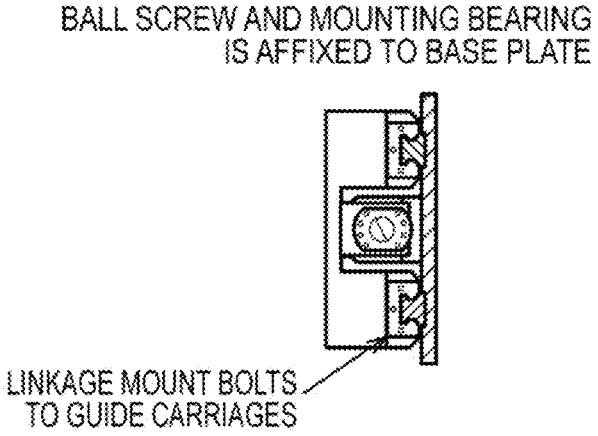
FIG. 6B is a side view of cross-section C-C shown in FIG. 6A.
Figure 6C:
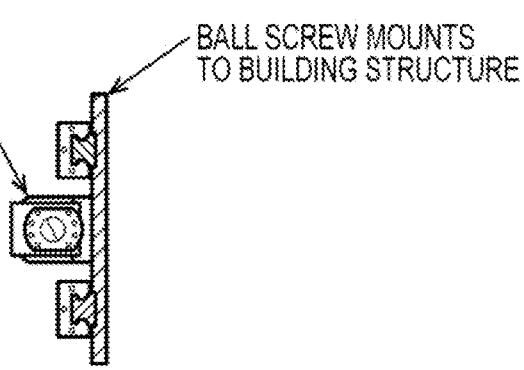
FIG. 6C is a side view of cross-section D-D shown in FIG. 6A.
Figure 6D:
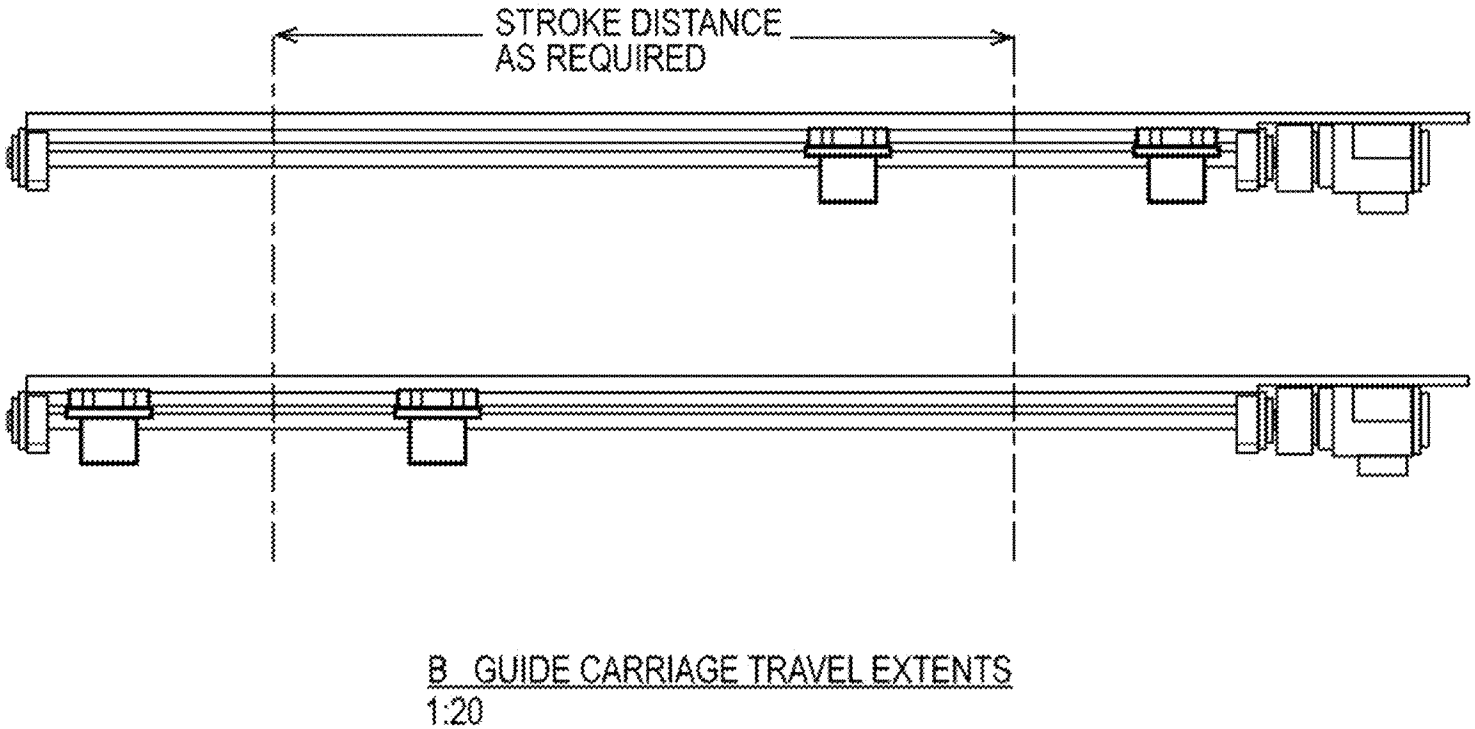
FIG. 6D is a top view of the mechanization assembly shown in FIG. 5, showing the extent that the guide carriage travels as this exemplary cladding system is reconfigured into a new position.

FIG. 6A is a rear view of the mechanization assembly shown in FIG. 5. FIGS. 6B and 6C show side-views of cross-sections C-C and D-D of FIG. 6A. As illustrated by these Figures, the guide carriage (6) of the mechanization assembly translates linearly along the mechanization assembly, actuating the linear motion of the operably connected linkage assemblies. FIG. 6D illustrates an example of the extent that a guide carriage may travel during actuation of a mechanization assembly.

Figure 7:
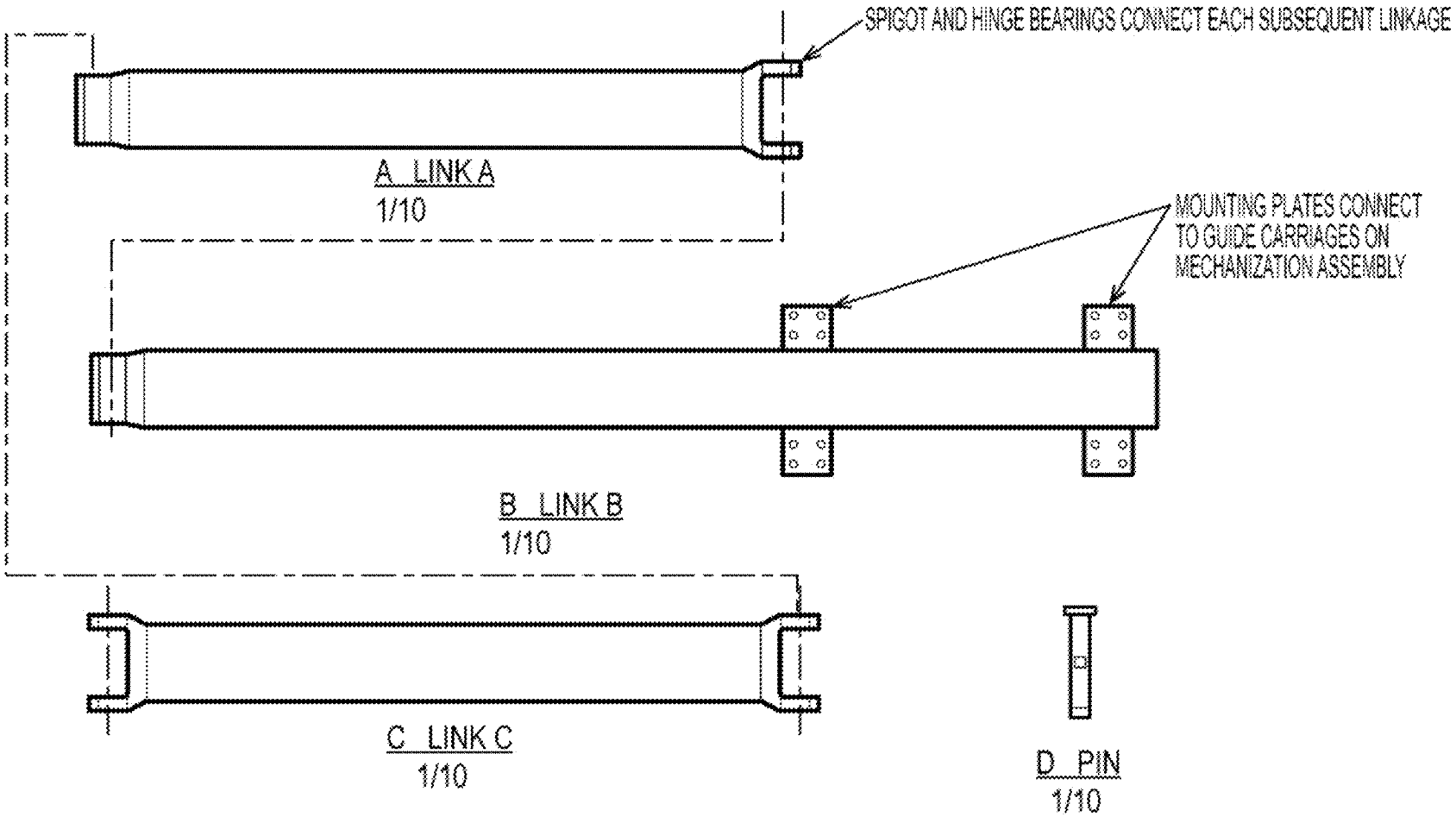
FIG. 7 depicts side views of three linkage assemblies (i.e., Link A, Link B and Link C) of the cladding system shown in FIG. 3, and a pin element used to connect these linkage assemblies together.

FIG. 7 depicts side views of three linkage assemblies (i.e., Link A, Link B and Link C) of the cladding system shown in FIG. 3, and a pin element used to connect these linkage assemblies together. As illustrated by this Figure, at least one linkage assembly of a given linkage system is affixed to a mechanization assembly. In this case, Link B is shown to incorporate mounting plates which are fixed to the guide carriages on a mechanization assembly. Links A, B and C are internally connected by the spigot and hinge bearings using a pin element. As noted above, this type of joint is purely exemplary. It is expressly understood that in other exemplary aspects, any known mechanical joint which allows rotational and/or translation movement of two connected elements may be utilized.

Figure 8:
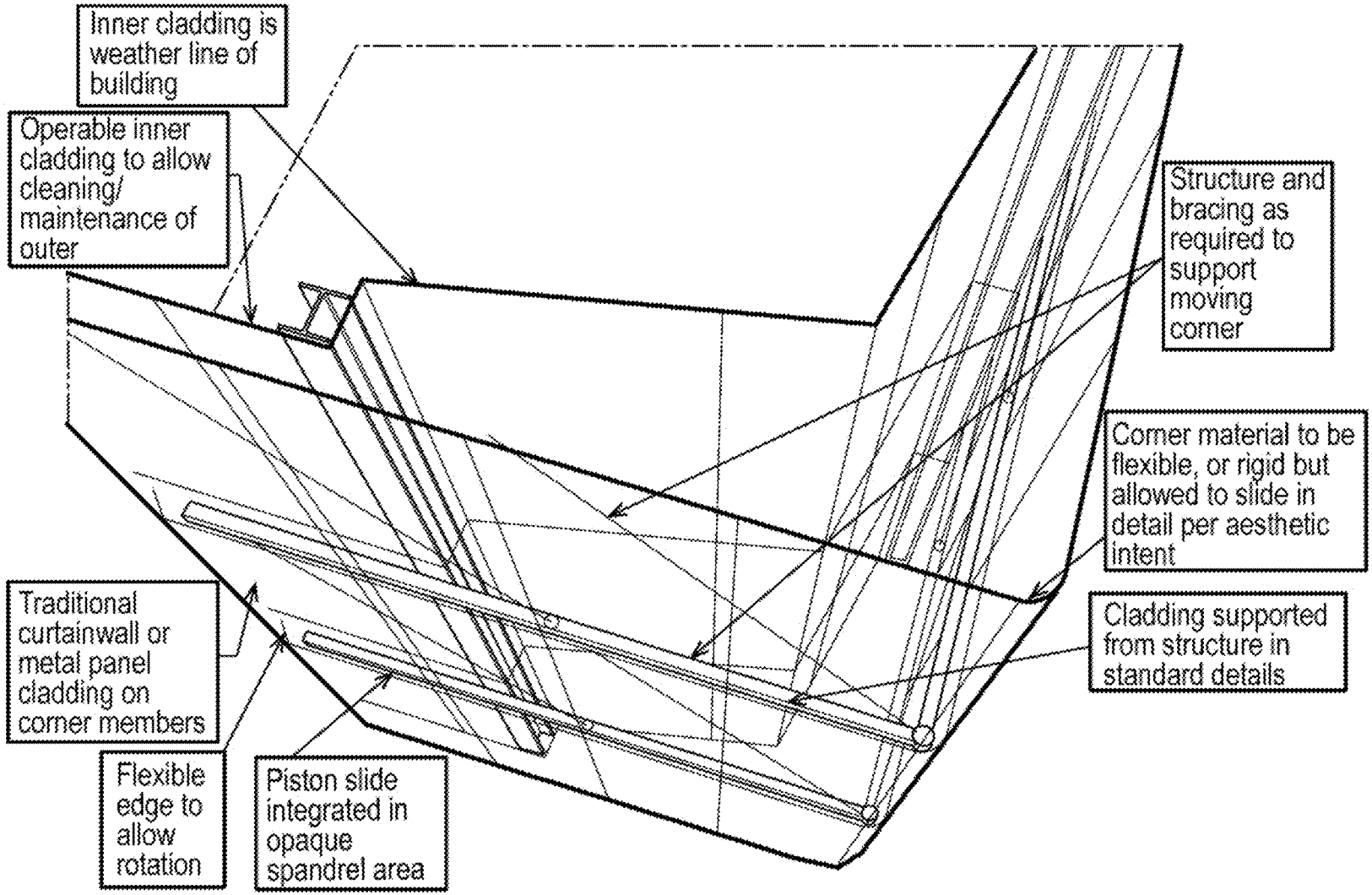
FIG. 8 is a perspective view of a cladding system according to the present disclosure installed on a representative building exterior.

FIG. 8 is a perspective view of a cladding system according to the present disclosure installed on a representative building exterior. As illustrated by this Figure, a cladding system according to the disclosure may be attached to an inner cladding of a structure, forming an adjustable outer cladding. The cladding system may comprise one or more outer facade panels attached to one or more linkage assemblies, which together operate as a linkage system controlled by at least one mechanization assembly. In this example, two such linkage systems are shown (e.g., controlling outer facade panels at different vertical heights). The outer facade panels may be constructed from any suitable material and may be transparent or opaque. As noted in this Figure, in some exemplary aspects, it may be desirable for outer facade panels spanning or located at the corner(s) of a structure to be constructed from a flexible material. In other aspects, these outer facade panels may alternatively be rigid. It understood that any degree of rigidity can be selected as desired to create a given aesthetic or to accommodate the reshaping of the outer facade. In some aspects, cladding systems according to the disclosure may be configured to reshape an outer facade of a structure by simply adopting a shape that reduces or minimizes wind-induced vibration (e.g., by corner softening). In other aspects, the reshaping process may be more complex. For example, the mechanical assemblies of a cladding system may be configured to adjust one or more linkage assemblies to produce a repeating harmonic movement of the outer facade panels (e.g., repeatedly shifting at least a portion of the outer facade at a frequency and/or amplitude sufficient to reduce or minimize wind-induced vibration).

Figure 9A:
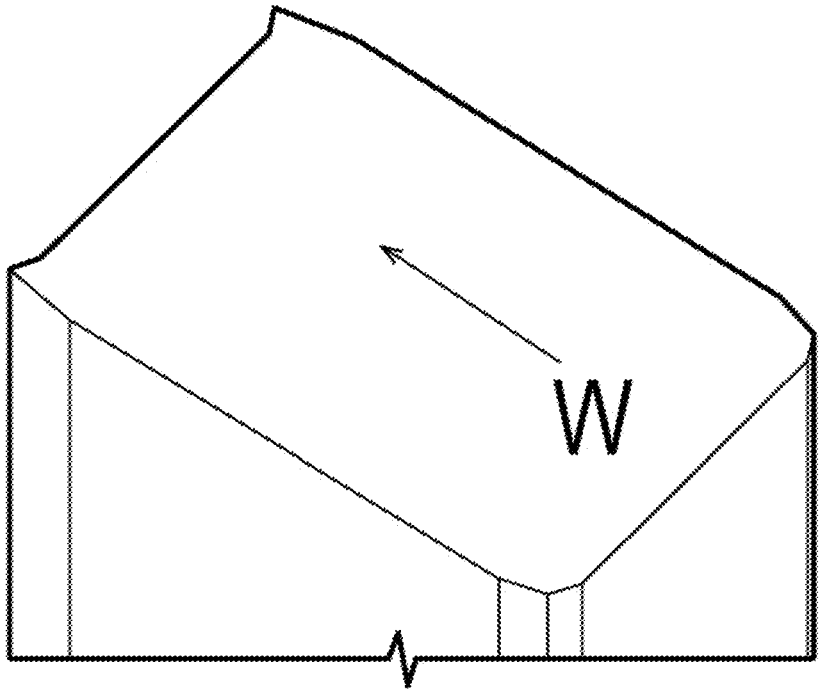
FIG. 9A is a perspective view of a representation of a building subjected to wind blowing in the direction indicated by the arrow shown in this Figure.

FIG. 9A is a perspective view of a representation of a building subjected to wind blowing in the direction indicated by the arrow shown in this Figure. As illustrated by this Figure, the four corners of this building comprise regions with adjustable cladding attached to the outer facade (e.g., the device shown in FIGS. 1A-1D). The movement of the movable panels of the cladding in these corner regions generates a deformed aerodynamic profile which reduces wind-induced vibration (e.g., swaying) of the structure.

Figure 9B:
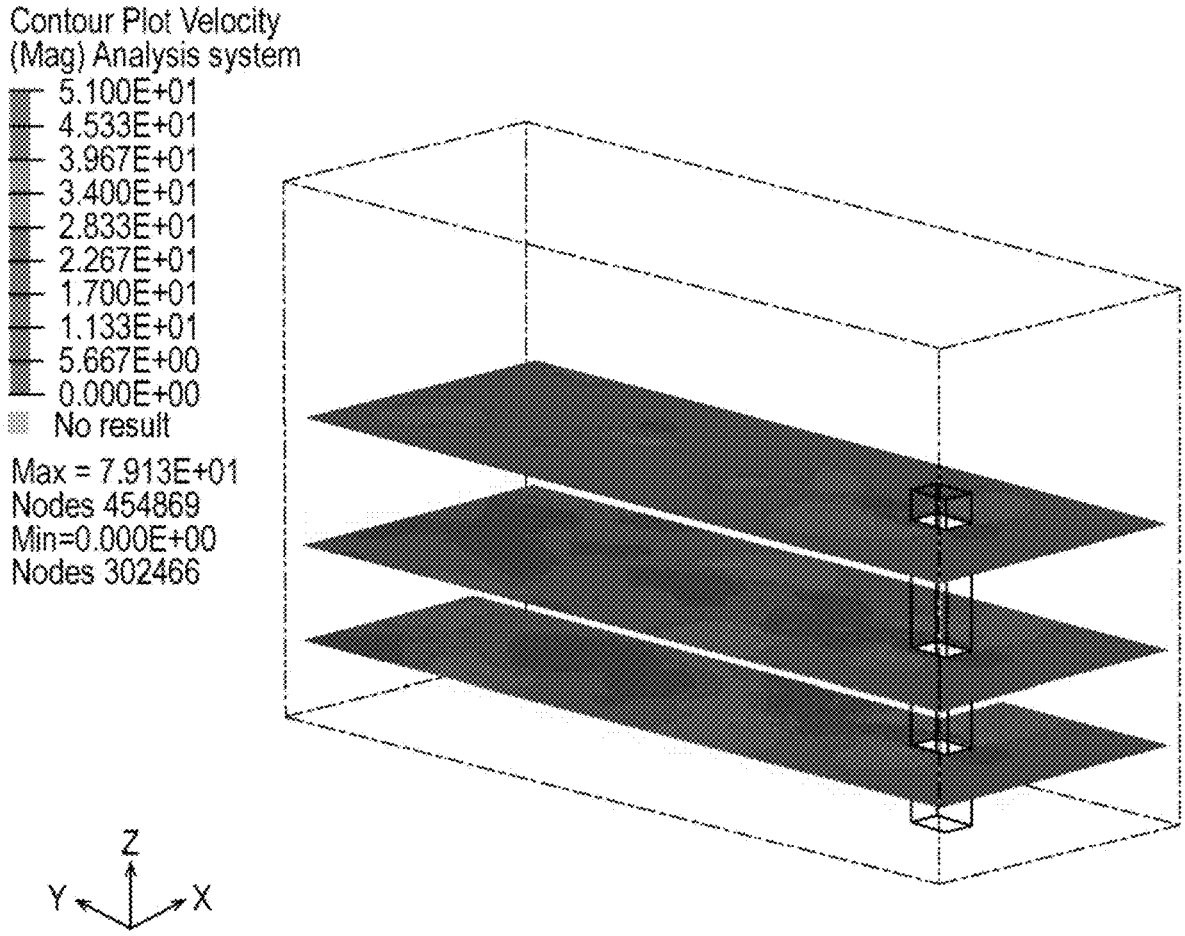
FIG. 9B shows the results of a modeling simulation which highlights the force of wind upon the building in the across-wind direction shown in FIG. 9A prior to aerodynamic deformation of the four corners.

FIG. 9B shows the results of a modeling simulation which highlights the force of wind upon the building shown in FIG. 9A prior to aerodynamic deformation of the four corners. This simulation includes heat maps depicting the magnitude of force exerted by the wind on the building at three different height. As illustrated by these results, different floor levels of a building may be subject to different degrees of wind-induced vibration. Accordingly, it is envisioned that cladding systems according to the disclosure may be installed on one or more floor levels of a building and be controlled independently to mitigate swaying of the building. For example, the computer or other electronic device controlling the cladding installations may set cladding units on different floors and/or different corners of one or more floors to move at a different frequency and/or amplitude.

Figure 9C:
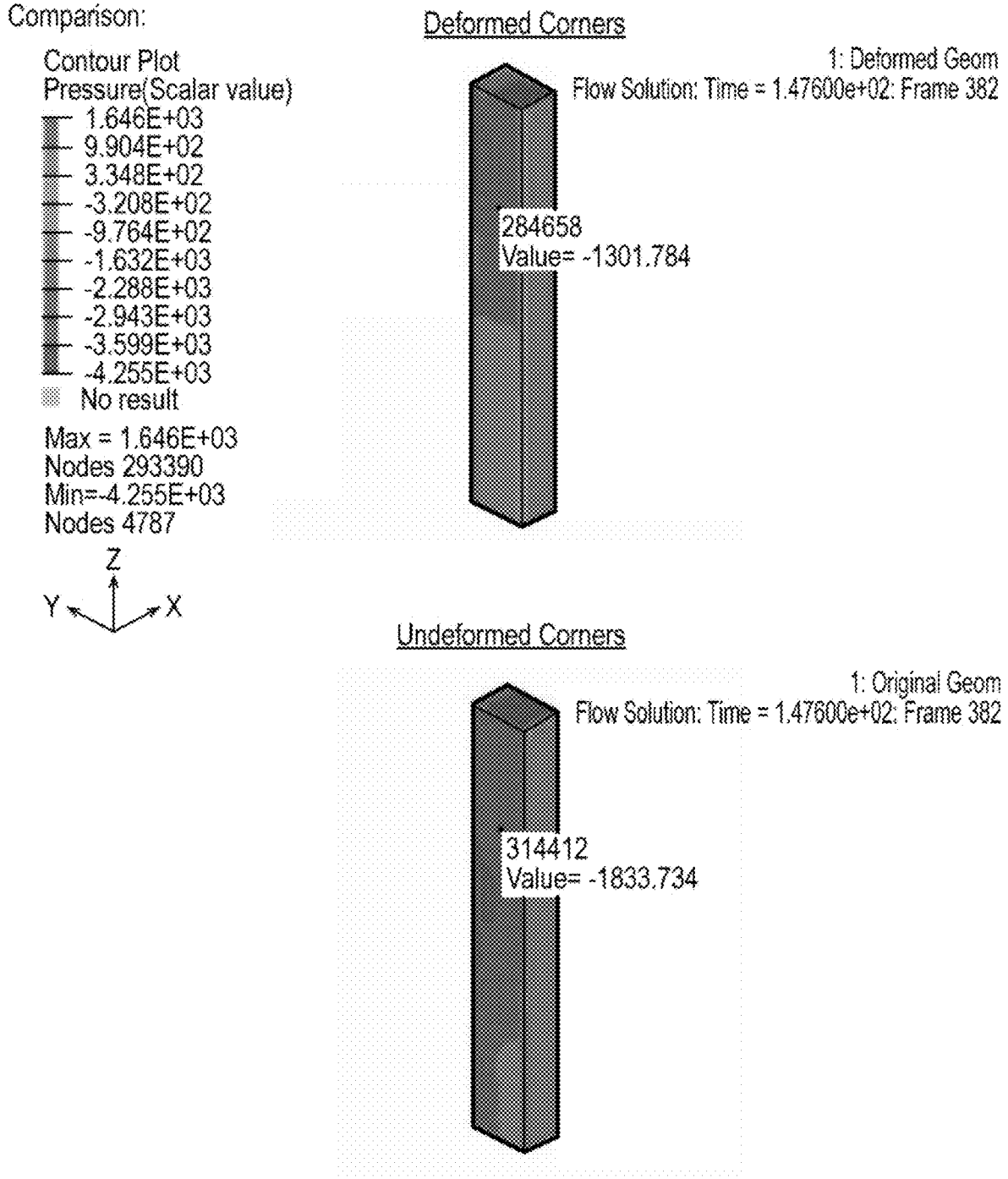
FIG. 9C shows comparative data obtained from a modeling simulation which examined the magnitude of force exerted by the wind on the building in the across-wind direction shown in FIG. 9A.

FIG. 9C shows comparative data obtained from a modeling simulation which examined the magnitude of force exerted by the wind on the building shown in FIG. 9A before and after aerodynamic deformation of the four corners using adjustable cladding (e.g., the device shown in FIGS. 1A-1D). As illustrated by these results, corner deformation using cladding systems as described herein may be implemented to reduce wind-induced vibration of a structure.

Figure 9D:
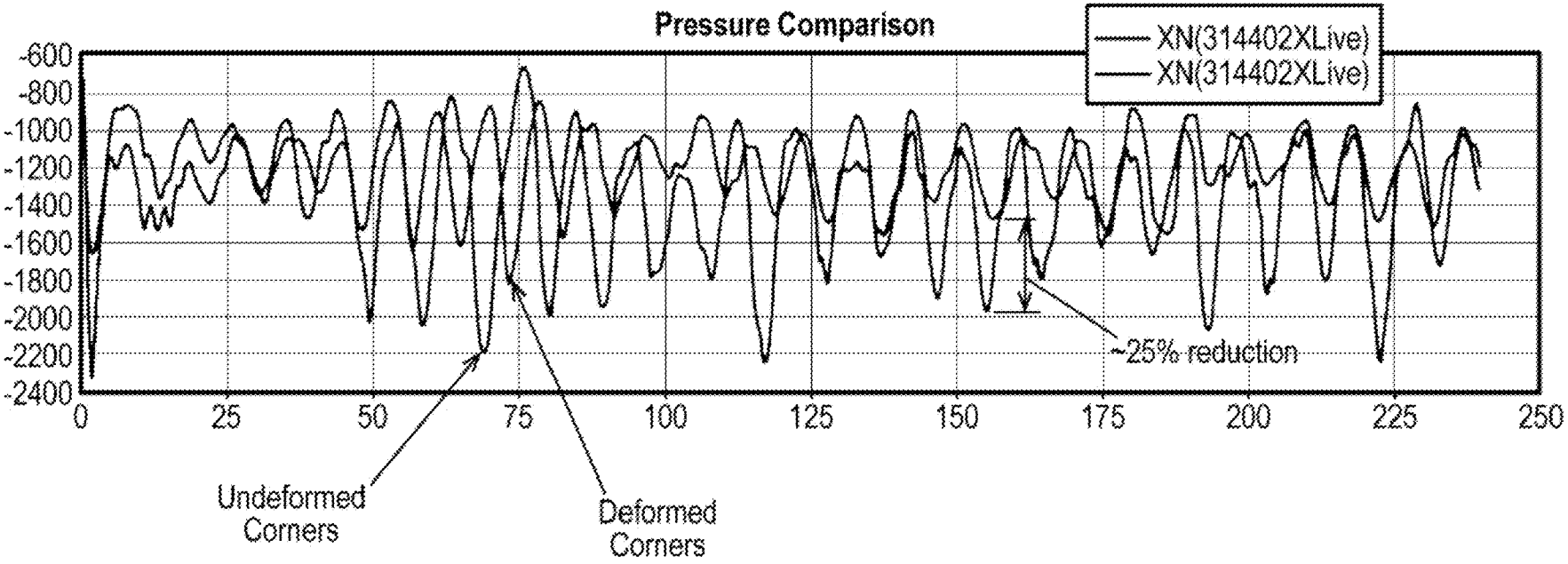
FIG. 9D depicts a graph illustrating the level of pressure exerted by the wind on the buildings shown in FIG. 9C over time.

FIG. 9D depicts a graph illustrating the level of pressure exerted by the wind on the buildings shown in FIG. 9C over time. As illustrated by these results, corner deformation substantially reduced the amount of wind-induced vibration of the building (e.g., by 25%) in this simulation.

The modeling data summarized in FIGS. 9A to 9D illustrates that the adjustable cladding systems described herein provide an effective solution for mitigating wind-induced vibration of a building. Such systems may be implemented using less space and/or at a reduced cost compared to traditional damper systems.

Figure 10:
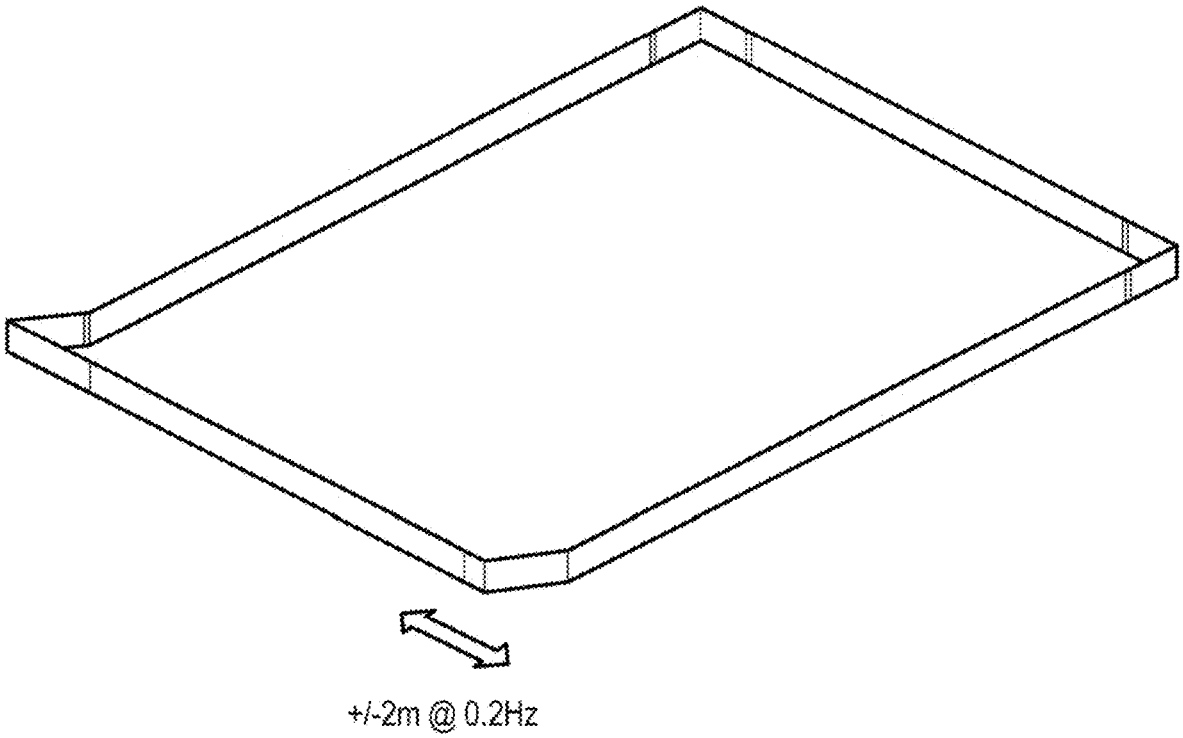
FIG. 10 illustrates the results of a modeling simulation of a building with deformed corners generated using an adjustable cladding system according to the disclosure.

FIG. 10 illustrates the results of a modeling simulation of a building with deformed corners generated using an adjustable cladding system according to the disclosure. In this simulation, a scenario was tested in which the two windward corners of the building were displaced perpendicular to the wind direction with an amplitude of 2.0 m and a frequency of 0.2 Hz. The natural frequency of vortex shedding for the building with rigid corners was determined to be 0.06 Hz.

Figure 11A:
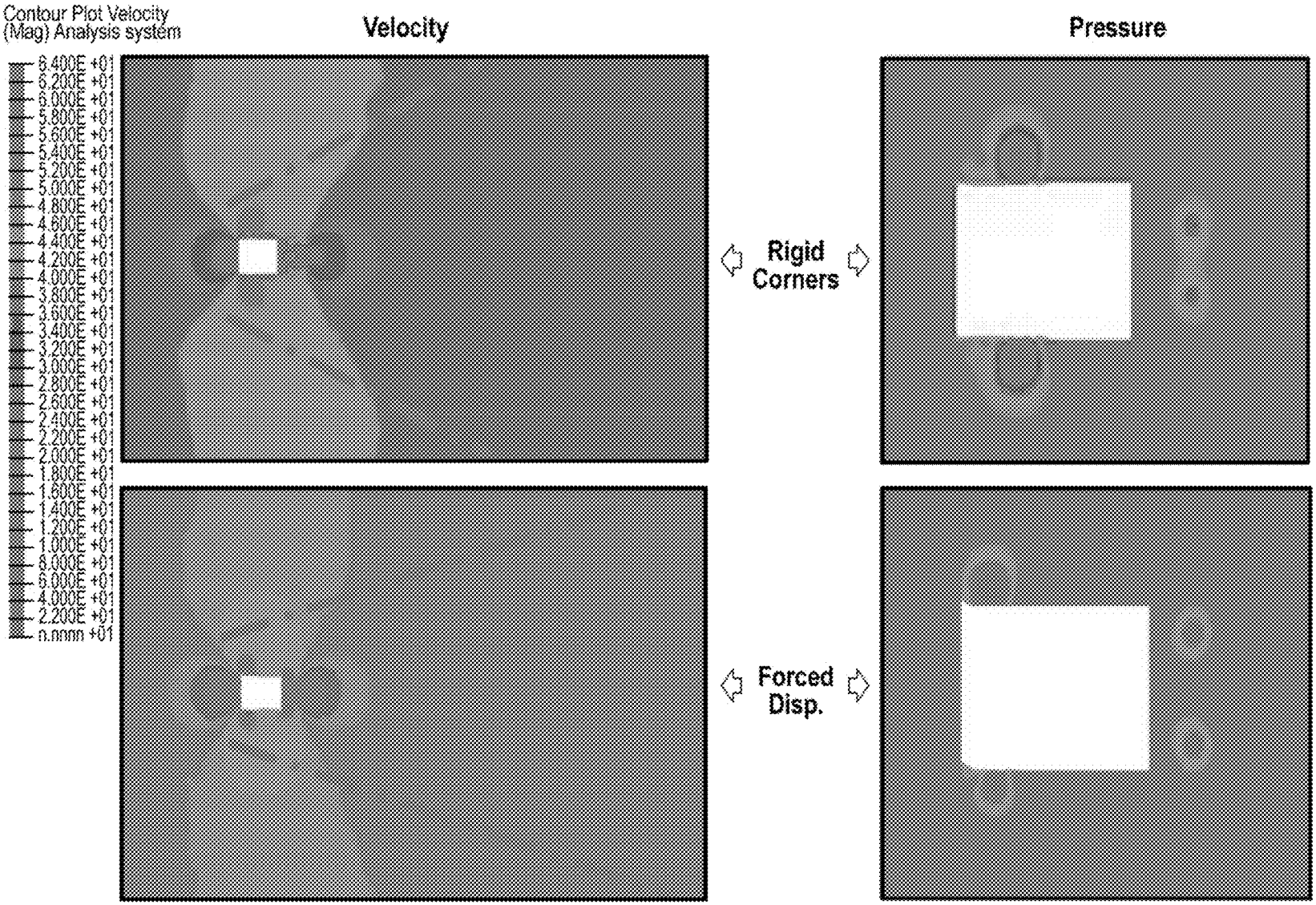
FIG. 11A illustrates the results of a computational fluid dynamic (CFD) software analysis with fluid structure interaction (FSI). In this scenario, a building with deformed corners and an equivalent building without deformed corners were subjected to simulated wind conditions and analyzed.

FIG. 11A illustrates the results of a computational fluid dynamic (CFD) software analysis with fluid structure interaction (FSI). In this scenario, a building with deformed corners and an equivalent building without deformed corners were subjected to simulated wind conditions. As illustrated by this Figure, the active-controlled displacement at the windward corners of the building with deformed corners generated a reduced wake profile, indicating it is more aerodynamic compared to the building with rigid corners.

Figure 11B:
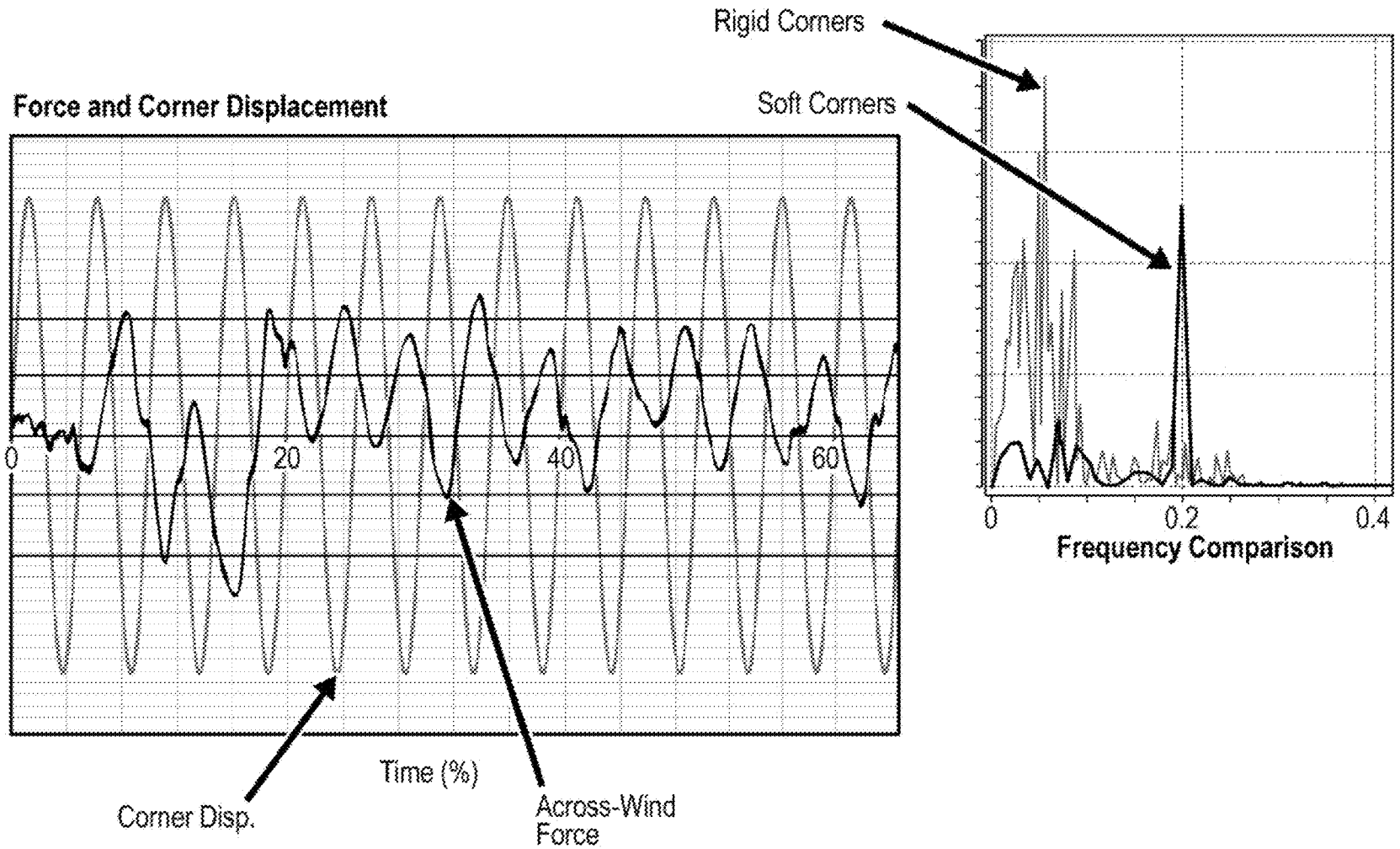
FIG. 11B is a graph depicting a superposition of windward corner displacement vs. time with net across-wind force applied to the building vs. time, generated from an analysis of the scenario modeled in FIG. 11A.

FIG. 11B is a graph depicting a superposition of windward corner displacement vs. time with net across-wind force applied to the building vs. time, generated from an analysis of the scenario modeled in FIG. 11A. The plot on the left is a superposition of windward corner displacement vs. time with net across-wind force applied to the buildings vs. time. The Y-axis scale is irrelevant. This plot demonstrates the across-wind force can be synchronized with the windward corner displacements. The plot on the right reports the various across-wind force frequencies for both the building with rigid corners and the building with displaced corners. The natural frequency of the rigid corner building (0.06 Hz) is effectively shifted to 0.2 Hz for the building with displaced corners, matching the input displacement frequency. This illustrates that adjustable cladding systems according to the disclosure may be used to control where and when wind forces attack a building.

Figure 12:
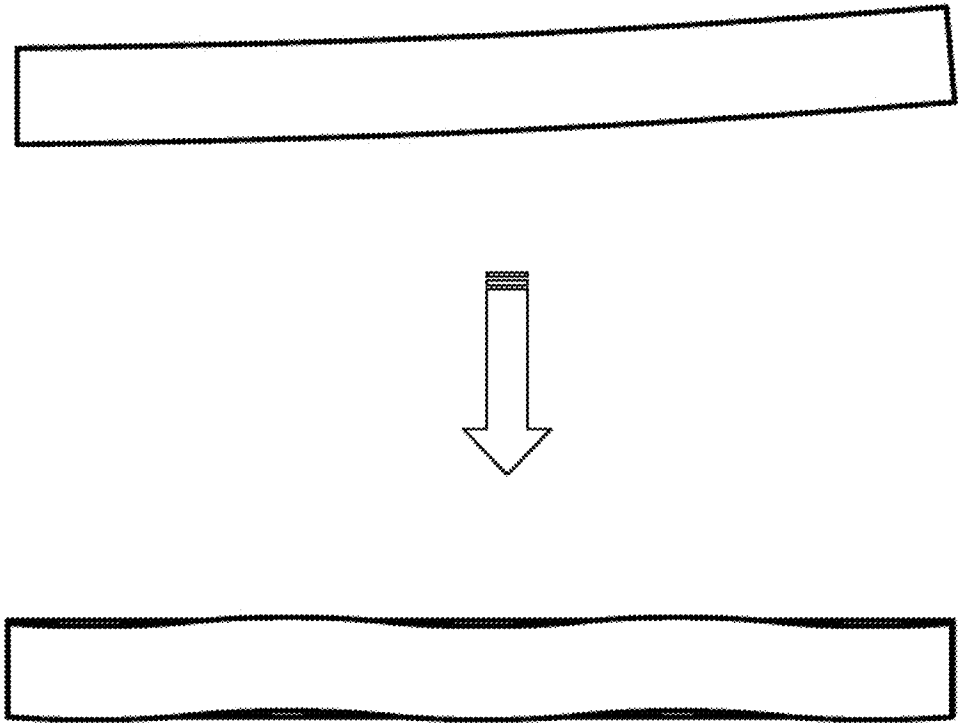
FIG. 12 is a graphic illustrating the across-wind sway of a typical building with rigid corners (left) and the minimized sway of a building fitted with an adjustable cladding system as described herein (light) under ideal conditions.

FIG. 12 is a graphic illustrating the across-wind sway of a typical building with rigid corners (left) and the minimized sway of a building fitted with an adjustable cladding system as described herein (right) under ideal conditions. Across-wind sway may be reduced or minimized by moving corner panels in different directions at different elevations. When positioned accordingly, the resulting profile results in a more favorable distribution of wind forces acting upon the structure so as to minimize overturning moment, sway, and its resulting discomfort felt by occupants. Moreover, installation of such a system may eliminate the need for large, expensive mass dampers at the top of the building, freeing up additional usable space for other purposes.

In the interest of clarity not all of the routine features of the aspects are disclosed herein. It will be appreciated that in an actual implementation of the present disclosure, implementation-specific parameters may be selected. It will be appreciated that the selection of such parameters may be complex and time-consuming, but would nevertheless be a routine undertaking of engineering for those of ordinary skill in the art having the benefit of the present disclosure.

Furthermore, it is to be understood that the phraseology or terminology used herein is for the purpose of description and not of restriction, such that the terminology or phraseology of the present specification is to be interpreted in light of the teachings and guidance presented herein, in combination with the knowledge available to a person of ordinary skill in the relevant art(s) at the time of invention. Moreover, it is not intended for any term in the specification or claims to be ascribed an uncommon or special meaning unless explicitly set forth as such in the specification.

The various aspects disclosed herein encompass present and future known equivalents to the known structural and functional elements referred to herein by way of illustration. Moreover, while aspects and applications have been shown and described, it would be apparent to those skilled in the art having the benefit of this disclosure that many more modifications than those mentioned above are possible without departing from the inventive concepts disclosed herein. For example, one of ordinary skill in the art would readily appreciate that individual features from any of the exemplary aspects disclosed herein may be combined to generate additional aspects that are in accordance with the inventive concepts disclosed herein.

Although illustrative exemplary aspects have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

The invention claimed is:

1. A method for reducing wind-induced vibration of a building, comprising:

receiving from a sensor, parameters describing wind speed and direction;

controlling, by processor, means for moving a plurality of movable panels forming a cladding attached to an outer facade of the building; and moving, at least some of the movable panels forming the cladding using the means for moving one or more movable panels, based upon the received parameters describing wind speed and direction;

wherein the movement of the movable panels is configured to redirect alternating wind flow around the building at one or more controlled frequencies.

2. The method of claim 1, wherein the at least some of the movable panels forming the cladding are moved at a frequency and/or amplitude that reduces wind-induced vibration of the building.

3. The method of claim 1, wherein the at least some of the movable panels forming the cladding are moved at a frequency and/or amplitude that minimizes wind-induced vibration of the building.

4. The method of claim 1, wherein the cladding is attached to the building by a plurality of sliding tracks configured to allow and/or control movement of the plurality of movable panels.

5. The method of claim 1, wherein the means for moving the movable panels comprises:

a) a hydraulic system; and/or b) at least one motor.

6. The method of claim 1, wherein the cladding is attached to at least a portion of an outer facade of the building.

7. The method of claim 1, wherein at least a portion of the cladding forms a corner of the building.

8. The method of claim 1, wherein one or more of the movable panels comprises a transparent or translucent portion.

9. The method of claim 1, wherein the processor is configured to control the movement of the movable panels by adjusting an amplitude and/or frequency of one or more of the movable panels.

10. The method of claim 1, wherein the processor is configured to control the movement of the movable panels in response to wind speed and/or direction parameters detected by a sensor attached or in proximity to the building.

11. The method of claim 1, wherein the controlled frequencies differ from one or more natural vortex-shedding frequencies of the building.

12. The method of claim 1, wherein the moving step comprises displacing at least some of the movable panels laterally in a harmonic motion with a predetermined frequency and amplitude.

13. The method of claim 1, wherein the moving step comprises moving at least some of the panels at a frequency that matches the building's natural frequency of vortex shedding.

* * * * *